United States Patent [19]

Fallon

[11] 3,959,933

[45] June 1, 1976

[54] CLAMPING FIXTURE FOR A DOUBLE DISC GRINDER

[75] Inventor: Herbert J. Fallon, Beloit, Wis.

[73] Assignee: The Bendix Corporation, Southfield, Mich.

[22] Filed: Apr. 16, 1975

[21] Appl. No.: 568,537

[52] U.S. Cl. ..... 51/217 R

[51] Int. Cl.[2] ..... B24B 41/06

[58] Field of Search ..... 51/217 R, 224, 114; 269/25, 254 R, 258

[56] References Cited

UNITED STATES PATENTS

| | | | |
|---|---|---|---|
| 376,451 | 1/1888 | Roberts | 51/114 |
| 2,354,794 | 8/1944 | Buehler | 269/25 |
| 2,504,609 | 4/1950 | Williams | 269/25 |
| 3,503,155 | 3/1970 | Dunn | 51/114 |
| 3,575,405 | 4/1971 | Harding | 269/258 |
| 3,877,181 | 4/1975 | Dunn | 51/217 R |

FOREIGN PATENTS OR APPLICATIONS

| | | | |
|---|---|---|---|
| 957,351 | 5/1964 | United Kingdom | 269/25 |

*Primary Examiner*—Al Lawrence Smith
*Assistant Examiner*—Nicholas P. Godici
*Attorney, Agent, or Firm*—John R. Benefiel

[57] ABSTRACT

A clamping fixture adapted to securely hold narrow workpieces for grinding in a double disc grinder is disclosed, the fixture including a moveable frame mounted on a support plate disposed within the moveable frame. The support plate has a workseat affixed to one end while the moveable frame carries a pivotal clamp positioned to be drawn into engagement with a workpiece disposed in the workseat by pulling movement exerted on the moveable frame to produce the clamping action. Both the moveable frame and the support plate are of reduced section in the portions thereof which are moved into the grinding zone during grinding in order to maximize the overall rigidity of the fixture against grinding-induced forces so that accuracy of the grinding process is enhanced.

7 Claims, 3 Drawing Figures

CLAMPING FIXTURE FOR A DOUBLE DISC GRINDER

BACKGROUND OF THE INVENTION

1. Field of the Invention

This invention concerns fixtures for grinding machines, and more specifically, workholding fixtures for double disc grinders.

2. Description of the Prior Art

In copending U.S. patent application Ser. No. 544,725, filed Jan. 28, 1975 entitled "Clamping Fixture for Double Disc Grinders", a clamping arrangement is disclosed which provides a simple but secure arrangement for clamping workpieces such as pump vanes during double disc grinding operations. While satisfactory for most applications, difficulties would be encountered in utilizing such a design for narrow width workpieces, i.e., vane widths on the order of 0.25 inches since if the various fixture parts were reduced in size accordingly, the fixture rigidity would not be adequate to yield acceptable workpiece tolerances.

It is an object of the present invention to provide a clamping fixture of the type described in the above-identified application but which is adapted for narrow workpieces.

SUMMARY OF THE INVENTION

This object and others which will become apparent upon a reading of the following specification and claims are accomplished by a workpiece fixture including a moveable frame mounted on a support plate disposed within the moveable frame. The support plate has a workseat affixed to one end while the moveable frame carries a pivotal clamp positioned to be drawn into engagement with a workpiece disposed in the workseat by pulling movement exerted on the moveable frame to produce the clamping action. Both the moveable frame and the support plate are of reduced section in the portions thereof which are moved into the grinding zone during grinding in order to maximize the overall rigidity of the fixture against grinding-induced forces so that accuracy of the grinding process is enhanced.

DETAILED DESCRIPTION

Figure 1:
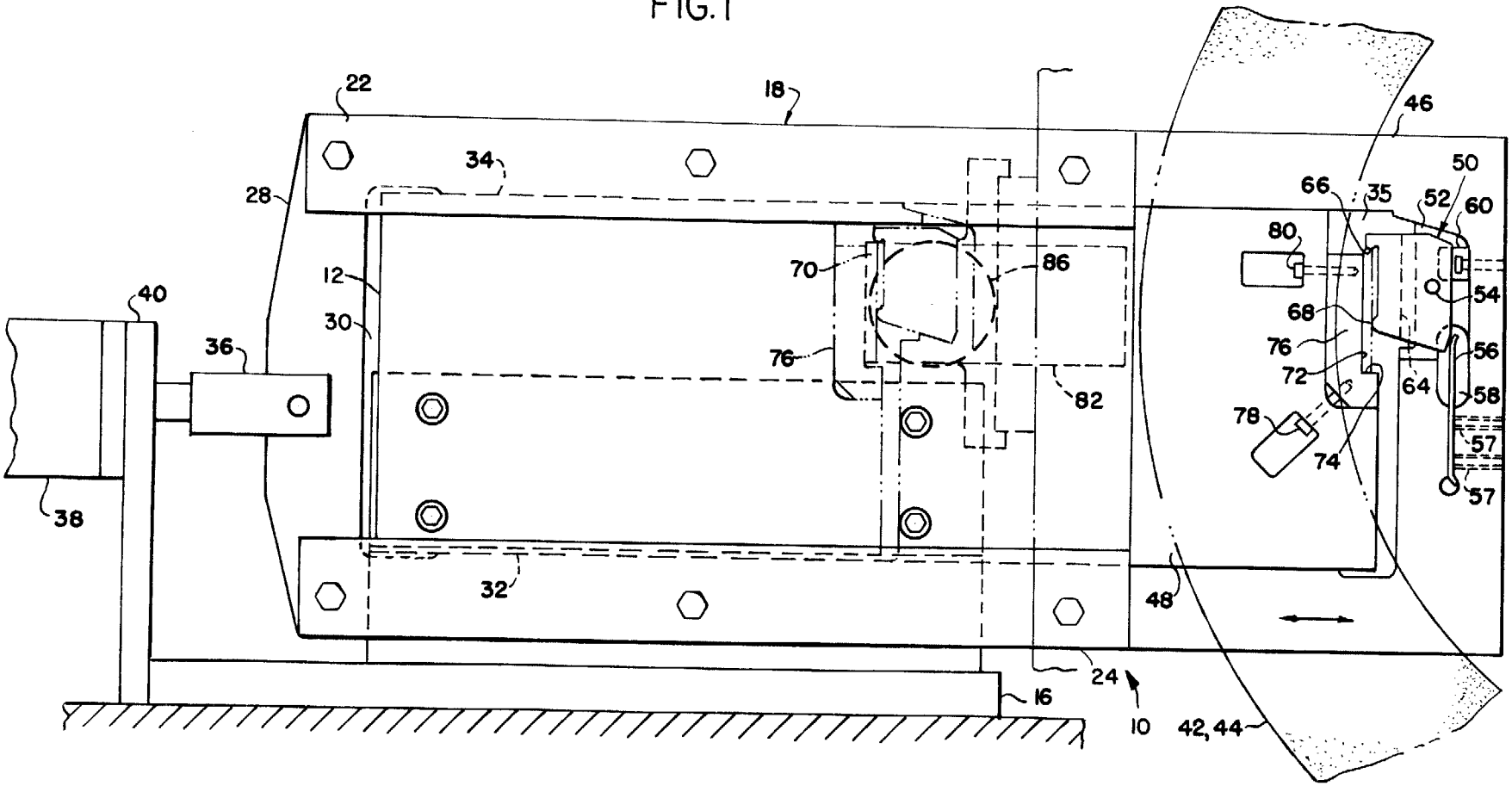
FIG. 1 is a side elevational view of a workholding fixture according to the present invention.
Figures 2, 3:
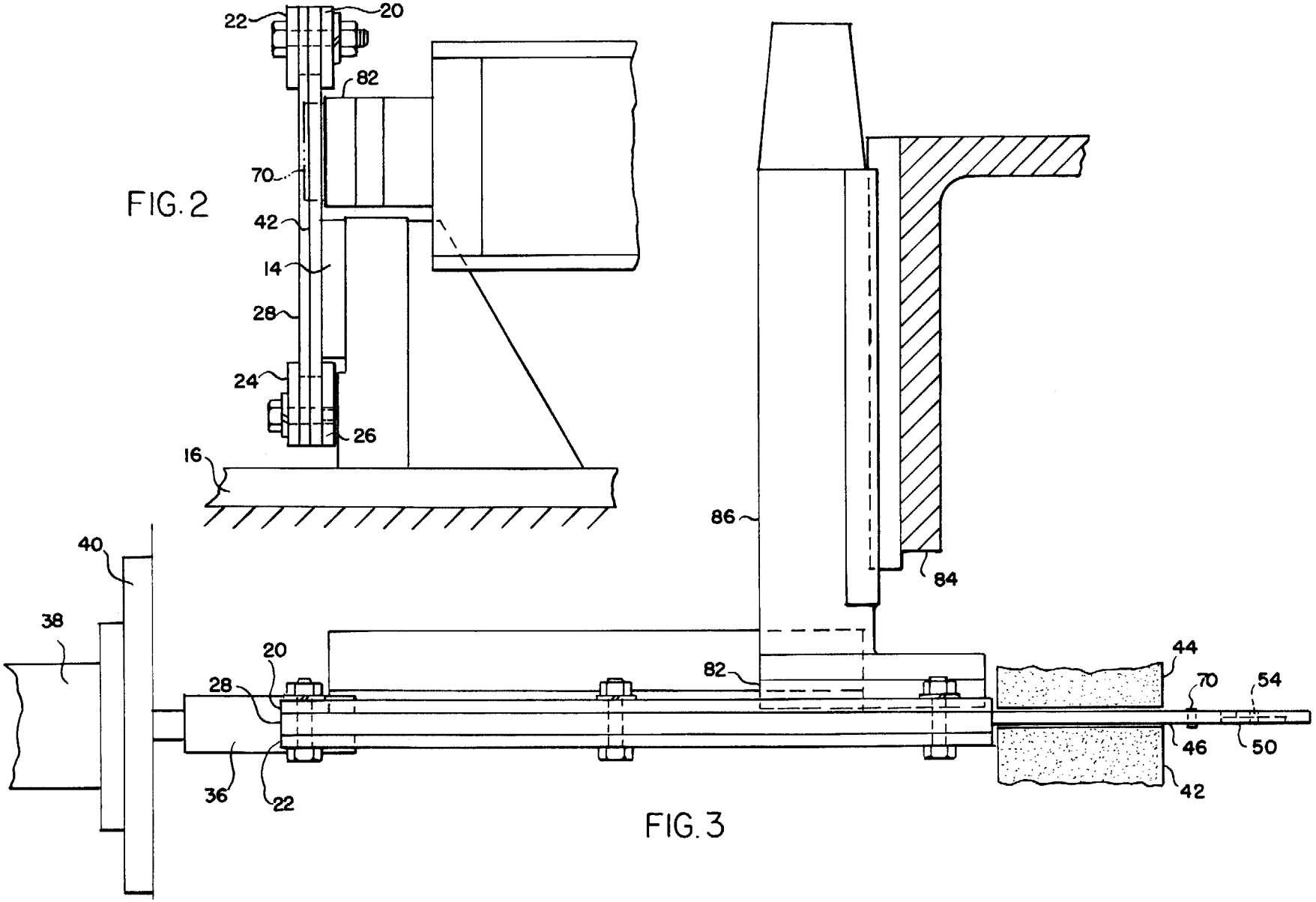
FIG. 2 is an end elevational view of the workholding fixture shown in FIG. 1.
FIG. 3 is a plan view of the workholding fixture shown in FIG. 1.

In the following detailed description certain specific terminology will be utilized for the sake of clarity and a specific embodiment will be described in order to provide a complete understanding of the invention, but it is to be understood that the invention is not so limited and may be practiced in a variety of forms and embodiments.

Referring to the drawings, the workholding fixture 10 includes a fixture support plate 12 affixed to an angle plate 14 which is in turn supported by an angle bracket 16 carried by the infeed table (not shown) of a double disc grinder. The infeed table is adapted to move the entire fixture into the grinding zone with a straight line motion.

Extending about the periphery and supported on the support plate 12, is a moveable frame 18 comprised of upper and lower pairs of bars 20, 22 and 24, 26 bolted together with a clamp plate 28 disposed therebetween. The clamp plate 28 has an opening 30 which allows the clamp plate 28 to be slidably fit over the fixture support plate 12 for relative sliding motion along edges 32 and 34, while being retained thereon by inner portions of the bars 20, 22 and 24, 26. Such relative motion is accommodated by a clearance space 35 between the support plate 12 and the moveable frame 18.

The outer portion of the clamp plate 28 is pinned to the actuating means including an actuating rod 36 of an actuating cylinder 38, supported on angle bracket 40.

In the area which is positioned between the grinding discs 42, 44 during grinding, the clamp plate 28 and fixture support plate 12 have portions 46 and 48 respectively reduced cross-sectional thickness corresponding to the available clearance between the grinding discs 42 and 44 in the full "in" position.

Supported on the portion 46 of the clamp plate 28 is a swivel clamp 50 disposed in the clearance space 35 and within a recessed area 52 on a pivot pin 54. Clamp plate 28 also carries a leaf spring 56 (retained with set screws 57) extending through a relieved area 58 and engaging the swivel clamp 50 to be rotated into engagement with a stop 60 affixed to the clamp plate 28. The portion of the swivel clamp 50 extending into the recess 52 is relieved so that the total thickness of the swivel clamp 50 and the remaining portion of the clamp plate 28 equals the unrelieved thickness of the reduced portion 46 of the clamp plate 28, while the swivel clamp 50 in the region extending into the clearance space 35 past the shoulder 64 is of a thickness equal to the total thickness of portion 46 to maximize the width of the clamping engagement surface to be described.

The swivel clamp 50 is formed with an upper clamping surface 66 and a leading clamping surface 68 adapted to engage the workpiece upon relative movement of the clamp plate 28 and support plate 12 such as to reduce the clearance space 35. These surfaces 66 and 68 are so located with respect to each other and the pivot pin 54 such that when the swivel clamp 50 is in position against the stop 60, the forward clamp surface 68 first engages the workpiece 70 causing the swivel clamp 50 to rotate counterclockwise against the bias of leaf spring 56 until the upper clamp surface 66 engages the upper surface of the workpiece to firmly seat the workpiece 70 both against the rear surface 72 and the lower surface 74 of a workseat 76 disposed in the clearance space 35 and fixed to the leading edge of the reduced portion 48 of the fixture support plate 12 by capscrews 78 and 80.

In order to insure accurate edgewise location of the workpiece 70 prior to the grinding operation, a workpiece locator plate 82 is provided proximate the location of the workpiece 70 so that its position may be accurately set at loading prior to clamping. The locator plate 82 also extends forwardly to a point just short of the discs 42 and 44 so that the workpiece 70 is "wiped" across the face thereof during infeed movement of the clamping fixture 10 to maintain this position accurately. Upon withdrawal, the stock removed during grinding provides clearance for the workpiece 70 to be withdrawn.

The locator plate 82 is thus fixed relative the clamping fixture 10 by being mounted to the machine frame 84 by an adjustable screw element 86 provided to allow fine in-and-out adjustment of the locator plate 82 to allow for differing workpiece 70 locations for the particular finish size of the workpiece.

In operation, the infeed table to which the plate 16 is fixed is initially in the "out" position such that the clamping fixture 10 is positioned so that the workseat 76 and swivel clamp 70 are located clear of the discs 42, 44 as partially depicted in phantom in FIG. 1.

A workpiece 70 is then loaded into the workseat 76 taking care that it is seated against the locator plate 82, and the cylinder 38 actuated to draw the swivel clamp 50 into engagement with the workpiece 70 and firmly clamp it to the workpiece 72. The infeed table then advances the clamping fixture 10 between the rotating grinding discs 42, 44 (which have previously been set to the proper gap) through the grinding zone and to the far side as shown in FIG. 1 and then withdrawn to the initial position, the cylinder 38 released to allow removal of the workpiece 70 and insertion of the next workpiece.

It can be appreciated that this design while accommodating quite thin workpieces is relatively rigid so that excessive deflections such as to cause degradations in the workpiece tolerances produced are avoided. This rigidity is achieved by (1) the relatively heavy sections of the fixture being extended up to a point just short of the grinding discs, (2) the relatively large cross-sectional area of the thin sections produced by the large transverse dimensions inherent in the plate-like members constituting the clamping fixture, and (3) the clamping action is produced by pulling of the moveable frame such that deflections caused by the clamping action are minimized.

This is achieved by a relatively simple device of a highly reliable mode of operation.

What is claimed is:

1. A workpiece clamping fixture for a double disc grinder comprising:

a support plate;

a moveable frame extending about the periphery of said support plate and mounted thereon for relative sliding movement with respect to said support plate with a clearance space between said support plate and said moveable frame accommodating said relative movement;

a workseat disposed in said clearance space and affixed to one of said support plate or said moveable frame;

clamping means also disposed in said clearance space and carried by the other of said support plate or said moveable frame adapted to clamp workpieces to said workseat by relative movement of said support plate and moveable frame in such a direction so as to reduce said clearance space; and actuating means for relatively moving said support plate and said moveable frame so as to cause said clamping means to be activated.

2. The clamping fixture of claim 1 wherein said clamping means includes a swivel clamp and means pivotally supporting said swivel clamp on one of said support plate or moveable frame so as to be adapted to be pivoted by engagement of a first leading surface formed thereon with a workpiece in said workseat, said swivel clamp also having a second surface brought into engagement with said workpiece upon pivoting movement of said swivel clamp induced by said engagement with a workpiece in said workseat.

3. The clamping fixture of claim 1 wherein said support plate and said moveable frame member are of reduced thickness for a portion of their lengths.

4. The clamping fixture of claim 2 wherein said means pivotally supporting said swivel clamp includes a relieved area on said one of said support plate or moveable frame into which a portion of said swivel clamp of reduced thickness is disposed, said portions being pinned together to allow said pivotal movement.

5. The clamping fixture of claim 2 wherein said support plate and said moveable frame member are of reduced thickness for a portion of their lengths.

6. The clamping fixture of claim 5 wherein said means pivotally supporting said swivel clamp includes a relieved area on said one of said support plate or moveable frame into which a portion of said swivel clamp of reduced thickness is disposed, said portions being pinned together to allow said pivotal movement.

7. The clamping fixture of claim 1 wherein said actuating means pulls said moveable frame member to reduce said clearance space.

* * * * *